US008702200B2

(12) United States Patent
Choy

(10) Patent No.: US 8,702,200 B2
(45) Date of Patent: Apr. 22, 2014

(54) WIDE-ARRAY INKJET PRINTHEAD WITH A SHROUD

(75) Inventor: Silam J. Choy, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/703,171

(22) PCT Filed: Aug. 19, 2010

(86) PCT No.: PCT/US2010/045978

§ 371 (c)(1),
(2), (4) Date: Dec. 10, 2012

(87) PCT Pub. No.: WO2012/023939

PCT Pub. Date: Feb. 23, 2012

(65) Prior Publication Data

US 2013/0083120 A1 Apr. 4, 2013

(51) Int. Cl.
*B41J 2/165* (2006.01)
*B41J 2/245* (2006.01)

(52) U.S. Cl.
USPC ..... 347/29

(58) Field of Classification Search
USPC ..... 347/29
See application file for complete search history.

(56) References Cited

U.S. PATENT DOCUMENTS

| | | | | |
|---|---|---|---|---|
| 4,502,054 | A * | 2/1985 | Brescia et al. | 347/55 |
| 6,471,330 | B1 | 10/2002 | Umeda et al. | |
| 6,626,518 | B2 | 9/2003 | Choy | |
| 6,679,595 | B2 | 1/2004 | Yamada et al. | |
| 6,722,756 | B2 | 4/2004 | Choy et al. | |
| 7,293,853 | B2 | 11/2007 | Berry et al. | |
| 7,480,994 | B2 | 1/2009 | Wood, III et al. | |
| 7,673,971 | B2 | 3/2010 | Timm et al. | |
| 2002/0051038 | A1 | 5/2002 | Ito | |
| 2002/0060715 | A1 * | 5/2002 | Karita et al. | 347/42 |
| 2003/0081066 | A1 | 5/2003 | Choy | |
| 2004/0001177 | A1 | 1/2004 | Byun et al. | |
| 2006/0092236 | A1 * | 5/2006 | Kwon et al. | 347/68 |
| 2008/0170109 | A1 | 7/2008 | Lee et al. | |
| 2009/0002442 | A1 | 1/2009 | Choi et al. | |
| 2010/0053265 | A1 * | 3/2010 | Kim et al. | 347/40 |

* cited by examiner

*Primary Examiner* — Stephen Meier
*Assistant Examiner* — Alexander D Shenderov

(57) ABSTRACT

A wide-array inkjet printhead assembly with a shroud includes a backbone, an array of die in which the die are mounted on die carriers. The die carriers are attached to the backbone and include support features. The shroud includes a capping surface, with a surface profile that deviates from a reference plane by more than a target deviation. The support features interface with and support an undersurface of shroud such that the capping surface of the shroud, when biased against the support features, deviates from the reference plane by no more than the target deviation.

15 Claims, 9 Drawing Sheets

Fig. 6A
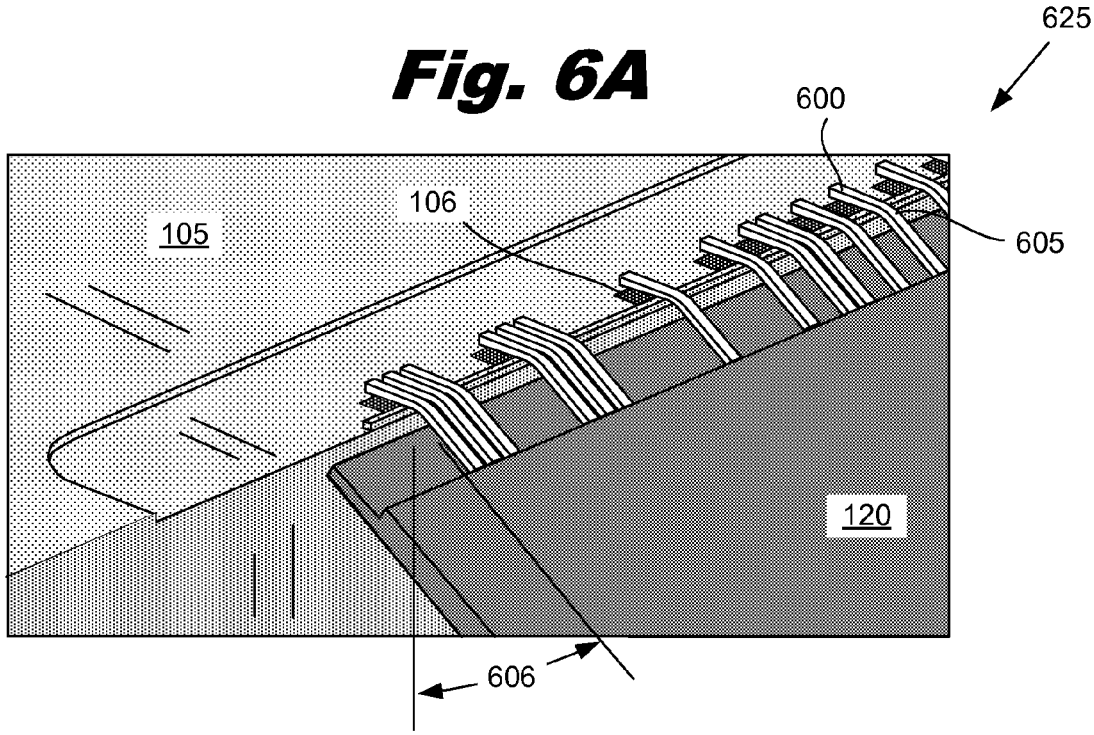
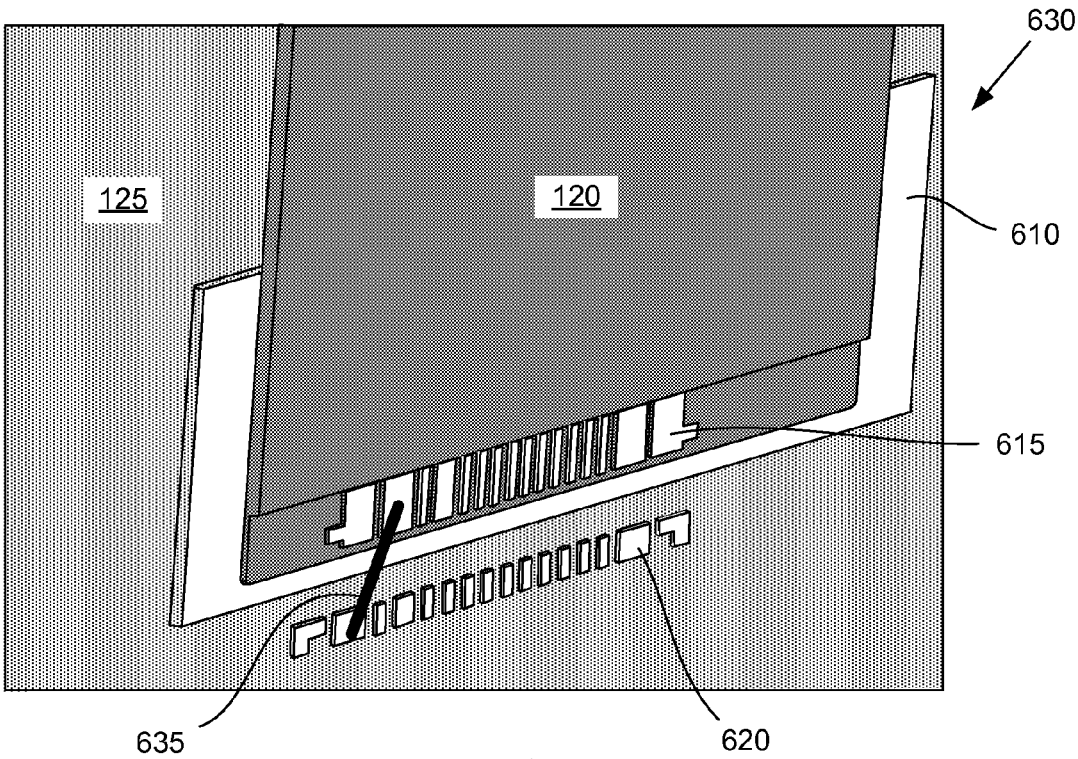
Fig. 6B

WIDE-ARRAY INKJET PRINTHEAD WITH A SHROUD

BACKGROUND

Wide-array inkjet printheads typically deposit ink across the width of a substrate as it is fed through the printer. Because the wide-array printheads are substantially as wide as the substrate, there is no need for translation of the printhead. However, the increased size of the wide-array inkjet printhead can also increase the number of components, increase the cost of the printhead, and lead to more stringent manufacturing tolerances.

BRIEF DESCRIPTION OF THE DRAWINGS

The accompanying drawings illustrate various embodiments of the principles described herein and are a part of the specification. The illustrated embodiments are merely examples and do not limit the scope of the claims.

FIGS. 6A and 6B show illustrative flex cable connections, according to one embodiment of principles described herein.

Throughout the drawings, identical reference numbers designate similar, but not necessarily identical, elements.

DETAILED DESCRIPTION

Figure 1:
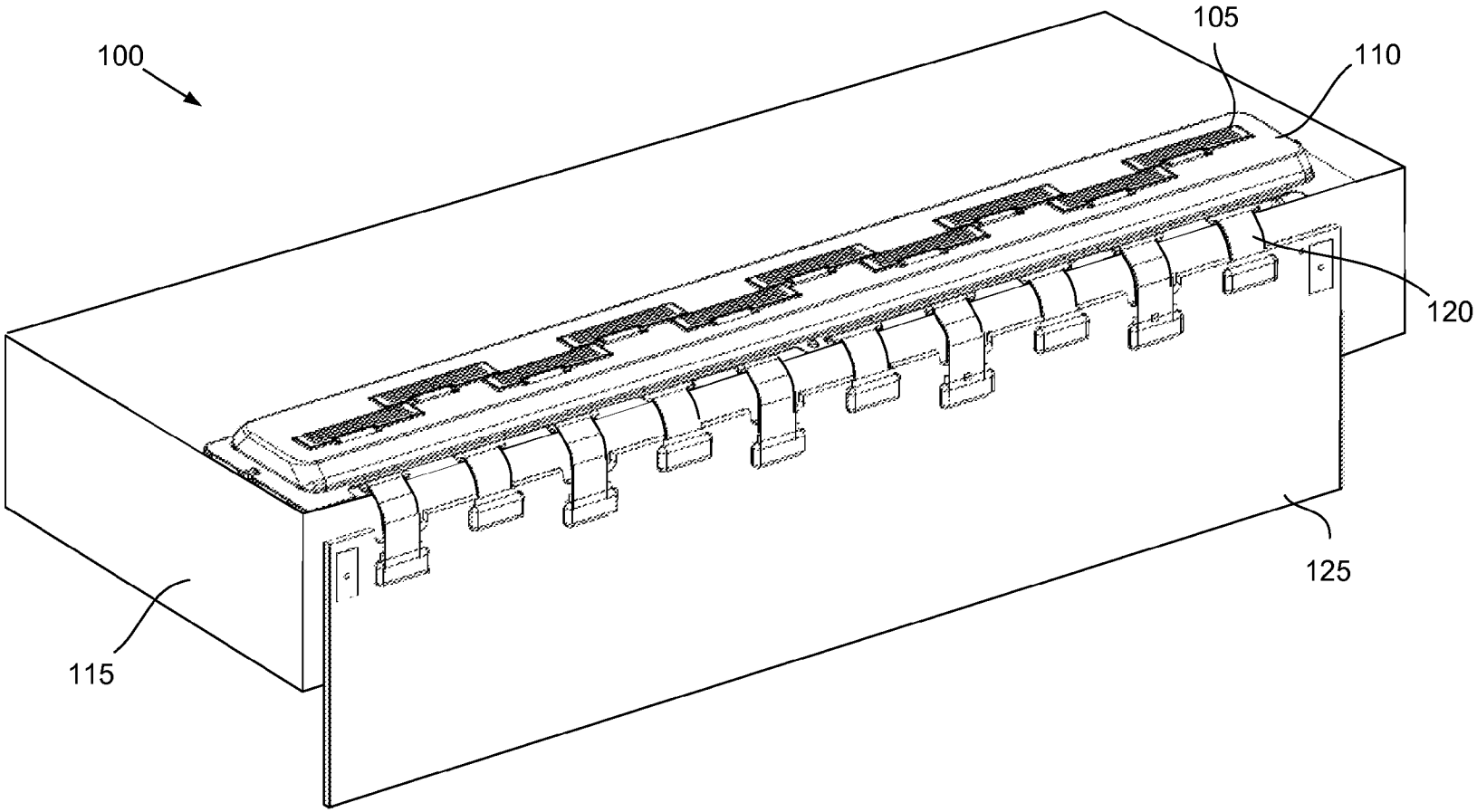
FIG. 1 is a perspective view of an illustrative wide-array inkjet printhead, according to one embodiment of principles described herein.

Wide-array inkjet printheads typically deposit printing fluid across the width of a substrate as it is fed through the printer. Because the wide-array printheads are substantially as wide as the substrate, there is no need for translation of the printhead. However, the increased size of the wide-array inkjet printhead can also increase the number of components, increase the cost of the printhead, and lead to more stringent manufacturing tolerances.

According to one illustrative embodiment, a wide-array inkjet printhead assembly is composed of an array of printhead die. These printhead die are among the highest precision components in the printhead assembly and contain the droplet ejection mechanisms. For example, the printhead die may contain thermal, piezo, or MEMs ejection elements. These ejection elements are activated to force droplets of fluid out of an array of nozzles. These droplets may have a volume on the order of 1-30 picoliters. The droplets may take the form of ink droplets deposited on a substrate to create the desired image.

The remainder of the printhead assembly supports this droplet ejection functionality of the printhead die. For example, a shroud can be placed around the array of inkjet die. The shroud serves a number of functions, including protecting the components it covers from damage/contamination and providing a capping surface that interfaces with a cap. The cap is placed onto the capping surface when the printhead assembly is not in use to create an enclosure over the die. The shroud and cap prevent the continued evaporation of the ink from the die. This prevents the accumulation of ink solids which could cause blockage or malfunctions of the inkjet die.

To seal effectively and not interfere with operation of the wide-array printhead assembly, it is desirable that the capping surface of the shroud meet a target profile specification. As used in the specification and appended claims the term "profile specification" refers to a requirement that all points on a surface must lie between two planes which are at specified locations relative to a reference plane and a specified distance apart. Thus, a profile specification defines both the location of a surface and allowable deviations of the surface. A profile specification can be applied to both flat and curved surfaces. For example, a profile specification of 0.100 millimeters for a flat surface means that all points must lie within two parallel planes which are 0.100 millimeters apart. The specified distance can be defined in a number of ways, including a range or a percentage. According to one illustrative embodiment, the target profile specification may be between 0.5% and 0.05% of the overall length of the printhead assembly. For example, if a wide array printhead assembly is designed to print across the full width of A4 paper, then the capping surface of the shroud which covers the die on the printhead assembly would be at least 210 millimeters in length. A profile specification of 0.2% requires that no part of the capping surface deviate from a reference plane by any more than ±0.21 millimeters. The target profile specification may be even more stringent depending on the application, cap design, width of the printhead assembly and other factors. For other applications the profile specification may be even more stringent. For example, for an A3 sized printhead assembly, the target profile specification to achieve the desired seal between a cap and the capping surface may be 0.1% of the overall length of the printhead assembly or shroud.

To create a shroud which is, by itself, precise enough to meet this flatness specification and structural enough to withstand wiping and capping forces without significant deflection can result in an expensive and bulky part. This specification describes a thin, flexible shroud which is manufactured using inexpensive techniques and does not, by itself, necessarily meet the profile specification or have the strength to withstand wiping forces without undue deflection. However, by biasing this shroud against other precision components, the capping surface of the shroud can be supported such that it meets both the profile specification and the deflection criteria.

Another significant challenge is to inexpensively route the electrical connections from a control board, through a wall of the enclosure and to the inkjet die. The electrical connections supply the die with electrical power and control signals to operate the ink ejection mechanism. The specification describes an effective, low cost method for sealing the electrical connections in the wall of the enclosure and minimizing the length of the electrical connections.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

FIG. 1 is a perspective view of an illustrative wide-array inkjet printhead assembly (100). The printhead assembly (100) includes a backbone (115), a plurality of inkjet die (105), a shroud (110), a circuit board (125) and flex cables (120) which electrically connect the die (105) to the circuit board (125). The backbone (115) structurally supports the printhead die (105) and routes ink to each of the printhead die (105). A manifold structure within the backbone (115) accepts ink from an ink reservoir and distributes the ink to the individual die (105). The shroud (110) attaches to the backbone (115) and encloses the die assemblies to provide a capping surface for a cap which is placed over the die (105) when the printhead assembly (100) is not in use. The shroud (110) and cap prevent the die (105) from drying out and subsequently malfunctioning. The shroud (110) may be formed from a number of materials using a variety processes. According to one illustrative embodiment, the shroud (110) is formed from stainless steel using sheet metal techniques.

The circuit board (125) electrically controls the individual firing mechanisms within the die (105) so that the appropriate color, amount, and pattern of ink (or other printing fluid) is ejected from the die (105). The circuit board (125) is connected to the die (105) by flex cables (120). Flex cables (120) contain a number of parallel conductors which are sandwiched between two flexible sheets. Typically, the flexible sheets are a plastic such as polyimide, polyester or PEEK films.

The inkjet die (105) are among the highest precision parts in the printhead assembly (100) and represent a significant portion of the cost of the printhead assembly (100). In a thermal inkjet system, the die (105) are typically manufactured from silicon using lithographic or other techniques to produce firing chambers which are arranged in a trench along the length of the die (105). The firing chambers include a cavity, a resistive heater adjacent to the cavity, and a nozzle. The ink is fed into the trench and enters the cavities of the firing chambers. To eject an ink droplet, an electrical current is passed through the flex cable (120) to the resistive heater. The heater rapidly heats to a temperature above the boiling point of the ink. This creates a localized vapor bubble in the ink filled cavity and sharply increases the pressure within the cavity. This ejects an ink droplet from the nozzle. After the current is removed, the heater rapidly cools and the vapor bubble collapses, thereby drawing more liquid into the cavity from the trench. For purposes of illustration, the geometry of the die (105) has been simplified in the figures. The die (105) are illustrated as having four parallel trenches which run along a substantial length of the die (105), with each trench being dedicated to a specific ink color. For example, each die (105) may dispense magenta, cyan, yellow and black ink. The die are arranged in a staggered configuration so that trenches from the die (105) are able to dispense ink of each color across substantially the entire width of a substrate which passes under the printhead assembly (100).

To ensure high print quality, the array of inkjet die (105) should be tightly aligned in all six degrees of motion. For example, all the printheads (100) may be coplanar to within 100 to 200 microns to ensure that the nozzle to media distance is substantially similar. This improves drop placement as the media is continuously advanced under the printhead assembly. The larger the variation in nozzle to media distance, the larger the dot placement error.

In most embodiments, the printhead assembly (100) would be at least as long as the media width. For example for A4 media, the staggered die (105) array would be at least 210 millimeters long and possibly longer. Additionally, for print quality, the printhead assembly (100) should deliver ink to the die (105) with a relatively uniform pressure. This helps to ensure that the ink droplets delivered by the inkjet die (105) are uniform.

Figure 2:
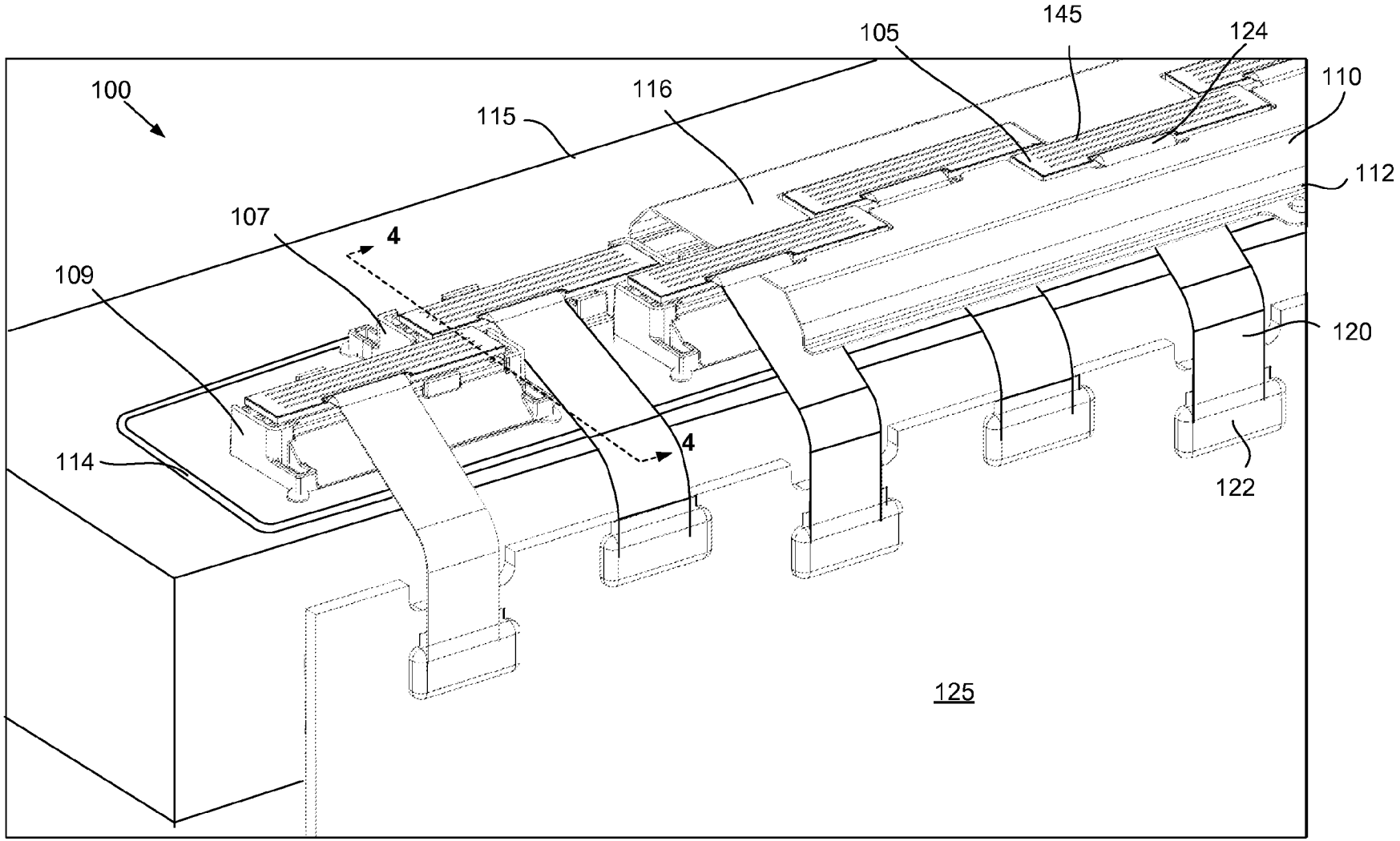
FIG. 2 is a partially cutaway view of an illustrative wide-array inkjet printhead, according to one embodiment of principles described herein.

FIG. 2 is a partially cutaway view of an illustrative wide-array inkjet printhead assembly (100). In this view, the shroud (110) has been partially cutaway to show the underlying die carriers (107, 109) and other aspects of the printhead assembly (100). In one embodiment, both the left and right die carriers (107, 109) are identical, but oriented in different directions. Because the die carriers (107, 109) are identical, only a single die carrier design needs to be manufactured. The higher volume production results in lower costs per part.

While there is a significant financial incentive to reduce the size of the die (105), reducing the size of the die eliminates sufficient area on the die (105) to create a seal to prevent undesired evaporation from the die (105) when the printhead assembly (100) is not in use. Further, because the staggered printhead die (105) are placed as closely as possible in the media advance direction, the placement of a capping surface between the back-to-back die (105) can be infeasible. The shroud (110) solves these issues by providing a capping surface (116) around the whole array of inkjet die.

The following examples are illustrative and are not meant to be limiting. For satisfactory performance of capping and wiping, the capping surface (116) may be vertically placed within 0.3 millimeters of the exposed surface of the die (105). The overall capping surface of the shroud (116) should have a variation of less then 0.5 millimeters. For A4 sized media, this results in deviations in the capping surface profile which are less than 0.15% of the shroud length. For A3 sized media, the profile specification is less than 0.1% of the shroud (110) length. These specifications are very stringent. As a comparison, these profile specifications are similar to commercial silicon wafer warp specifications in semiconductor manufacturing operation. Additionally, the shroud should resist capping and wiping forces with minimal deflection.

To meet these specifications, one of ordinary skill in the art would design an expensive, rigid shroud (110) which would exhibit the desired flatness and stiffness. However, according to one illustrative embodiment, the shroud (110) is fabricated from thin stainless steel sheet metal. In one embodiment, the stainless steel sheet metal could have a thickness which ranges from 0.5 millimeters to 0.1 millimeters in thickness, depending on the type of stainless steel, the annealing of the stainless steel, the shape of the shroud and other factors. For example, the stainless steel sheet metal could be 304 series metal that has been annealed and has a thickness of approximately 0.2 millimeters +/−0.1 millimeters. A variety of other materials could be used. Ideally, the shroud material would have a Coefficient of Thermal Expansion (CTE) which matches the length wise CTE of the printhead assembly. Additionally, the thickness can be varied. In general, it is anticipated that for annealed stainless steel, the thickness would be less than 0.5 millimeters. The thinner the shroud (110), the closer the shroud (110) can be placed to the die (105) and flex cable without interference. Because of the thinness of the sheet metal, the shroud (110) is quite flexible until it is attached to the printhead assembly. The shroud (110) is not designed or constructed to exhibit the desired surface profile until it is joined to the printhead assembly (100). Consequently, it can be manufactured using any of a variety of techniques. According to one illustrative embodiment, the shroud (110) is formed and punched with standard sheet metal fabrication techniques. For example, sheet metal fabrication techniques may include deep drawing, cutting using a variety of techniques, punching, press brake forming, rolling, stamping, bending, decambering, or other techniques.

The shroud (110) includes a flange (112) which is sealed to a rail (114). The rail (114) is a molded feature which encircles the mounted die carriers (107, 109) and includes indentations in its sealing surface where the flex cables (120) pass over the rail (114). According to one embodiment, the flex cables (120) are sealed into the indentations and then the shroud (110) is sealed to the rail (114) and over the flex cables (120). The shroud (110) serves at least three functions. First, the shroud (110) protects the underlying components from damage and contamination. Second, the shroud (110) provides a capping surface (116) which is at approximately the same level as the top of the die (105). This capping surface (116) supports a wiper which passes over and cleans the die (105). Third, the shroud (110) provides a uniform sealing surface for a cap which covers the die (105) when the printer is not in use. Sealing the cap onto the capping surface (116) of the shroud (110) can prevent the evaporation of solvent from the ink. When the solvent evaporates, the ink solids are left behind. These ink solids can accumulate and cause a number of issues including blocked nozzles and misdirected ink droplets. The cap seals onto the shroud (110) to enclose the die (105) in a sealed cavity. As ink begins to evaporate from the die (105), the humidity in the sealed cavity increases and prevents further evaporation.

As discussed above, a flex cable (120) connects each die carrier (107, 109) to the circuit board (125). The first end of the flex cable (120) makes a first connection with the circuit board (125) which is labeled in FIG. 2 as the board connection (122). The second end of the flex cable (120) makes a second connection with the contact pads on the die (105) which is labeled in FIG. 2 as the die connection (124). These connections (122, 124) may be made in a variety of ways. One design aspect of the die connection (124) is that the die connection (124), and the flex cable (120) as it leaves the die connection, (124) should not interfere with the fit of the shroud (110).

Figure 3A:
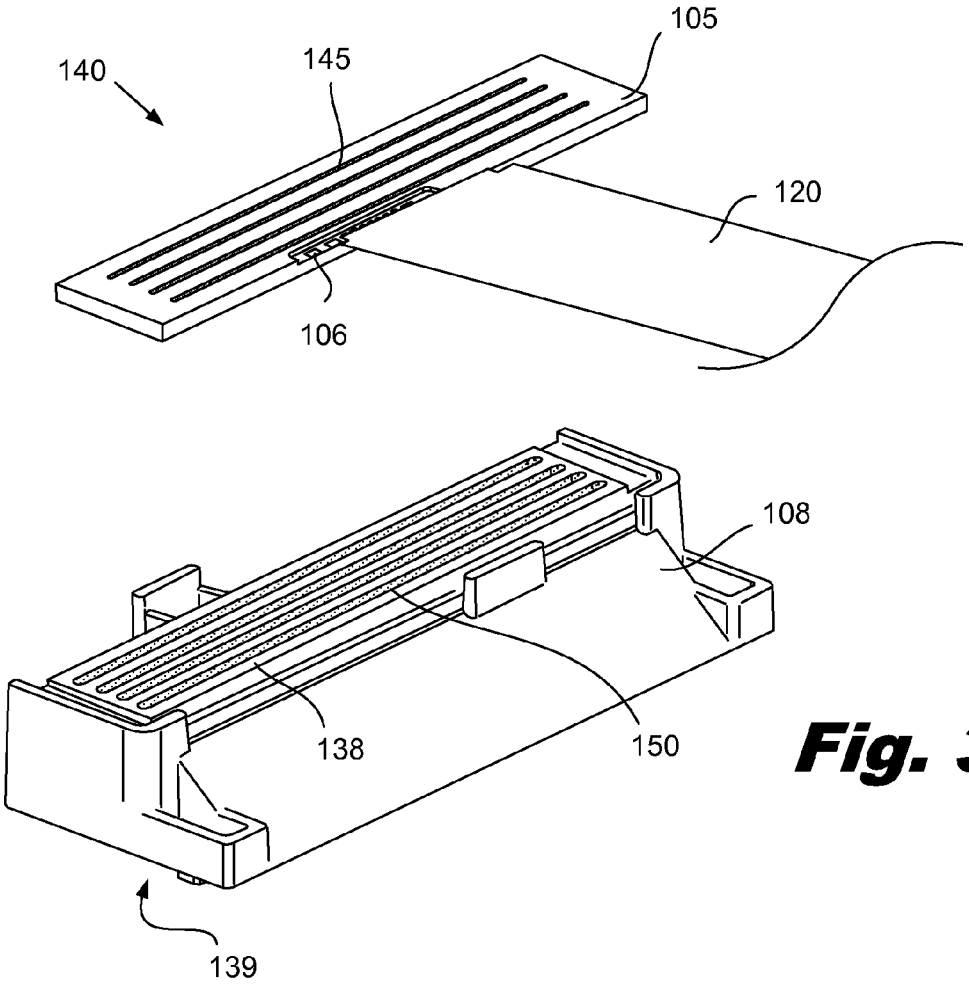
FIG. 3A is an exploded view of an illustrative die assembly which includes a die carrier, according to one embodiment of principles described herein.

FIG. 3A is an exploded view of an illustrative die assembly (140) which includes a die carrier (108), adhesive (130), die (105), and a flex cable (120). The lower surface (139) of the die carrier (108) is sealed over manifold slots in the backbone (115, FIG. 2). Oblique tapered channels (150) in the die carrier (108) direct fluid from the lower surface (139) to the upper surface (138) of the die carrier (108). At the upper surface (138) of the die carrier (108) the oblique tapered channels (150) have approximately the same pitch and length as the trenches (145) in the die (105). Thus the oblique tapered channels (150) direct ink from the manifold slots in the backbone (115, FIG. 2) through the die carrier (108) and into the trenches (145).

The die (105) is adhered to the upper surface (138) with adhesive (130). Because the die carrier (108) is similar in length to the die (105), the die carrier (108) can be molded flat enough to allow the die (105) to be bonded to the die carrier (108) without requiring costly secondary operations. For example, if a 25 millimeter long die requires an upper surface flatness of 0.1 millimeter, the flatness specification is 0.4% of the die carrier length. This is within the capability of precision thermoplastic injection molding without any secondary operations.

The flex cable (120) is attached to the die contacts (106). According to one embodiment, the electrical conductors in the flex cable (120) are copper ribbons or wires which are covered with gold. These copper ribbons extend beyond the sandwiching polymer films. The copper ribbons are attached to the gold plated die contacts (106) using Tape Automated Bonding (TAB). After making the electrical connections, a number of additional operations can be performed to ensure that the connection is electrically/mechanically secure and that the flex cable (120) exits the connection at the desired angle. For example, the connection may be encapsulated with a curable polymer (i.e. "glob topping"). In some embodiments, a small amount of curable polymer may be deposited under the flex cable (120) and adhere to the underside of the flex cable (120) to the die (105) and/or die carrier (108). An additional quantity of curable polymer is then deposited on top of the connection.

Figure 3B:
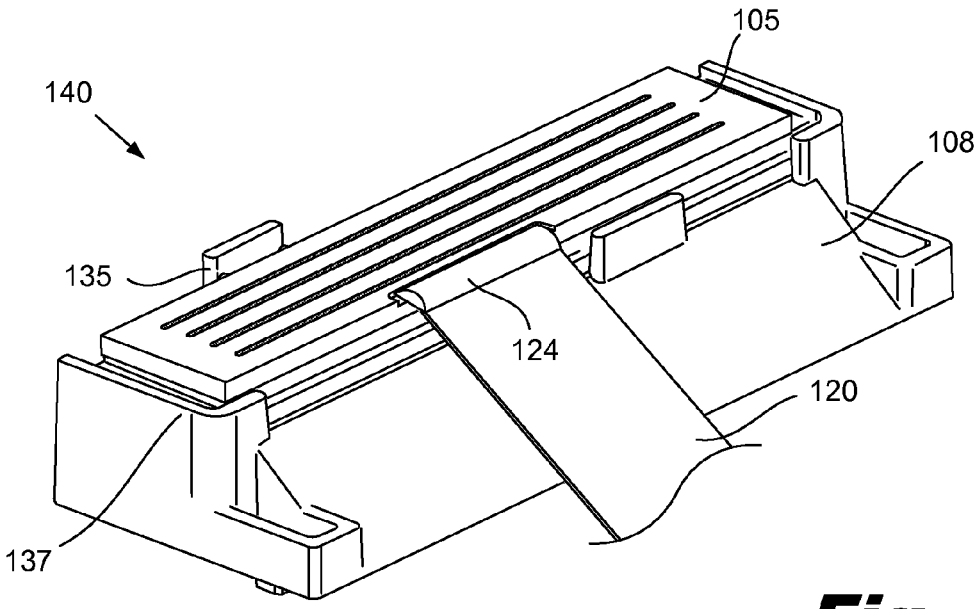
FIG. 3B is a perspective view of an illustrative die assembly which includes a die carrier, according to one embodiment of principles described herein.

FIG. 3B is a perspective view of a die assembly (140). The die assembly (140) includes the die (105), the die carrier (108), the flex cable (120) and the die connection (124). The die assembly (140) is a modular unit which can be independently tested to verify its functionality. For example, the die assembly (140) can be electrically tested to verify that the flex cable (120) makes a proper electrical connection with the die (105) through the die connection (124). The electrical test may also include checking electrical functions of the die (105). For example, the resistance of the various heater elements in the die (105) can be measured by attaching appropriate testing equipment to the opposite end of the flex cable (120).

The embodiment of the die assembly (140) shown in FIG. 3B has a right facing die carrier (109, FIG. 2). To form a die assembly (140) with a left facing die carrier (107, FIG. 2), the die carrier (108) is rotated 180 degrees prior to adhering the die (105) to the upper surface (138, FIG. 3A) of the die carrier (108). However the die (105) and flex cable (120) orientation remains the same. This allows the flex cables (120) on both the right and left facing die carriers (108) to come off the same side and simplifies their connection to a single circuit board (125, FIG. 2).

The shroud (110, FIG. 2) covers the die carriers (108) and flex cable (120) as much as possible without interfering with the die, electrical connections and flex cable (120). The die carriers (108) include a number of features which are configured to interface with and support the shroud (110, FIG. 2). In this example, the support features include posts (135) on either side of the die (105) and corners (137) at either end of the die carrier (108). The upper surfaces of these support features (135, 137) are formed in a common plane. As discussed above, the die carriers (108) are placed with a significant amount of precision on the backbone (115, FIG. 1). In some embodiments, the die carriers (108) are positioned so that their support features (135, 137) are significantly more coplanar than the backbone (115, FIG. 1) which supports them. When the shroud (110, FIG. 2) is put in place, the support features (135, 137) make contact with the under surface of the shroud (110, FIG. 2). This provides additional support for the center of the shroud (110, FIG. 2) and prevents undesired deflection of the capping surface (16, FIG. 2) when the shroud (110, FIG. 2) is subjected to wiping or capping forces.

The die carriers and their interaction with the backbone and die are further discussed in U.S. patent application Ser. No. 13/703,150 entitled "Wide-Array Inkjet Printhead Assembly," to Silam J. Choy et al., filed Dec. 10, 2012, which is hereby incorporated by reference in its entirety.

Figure 4A:
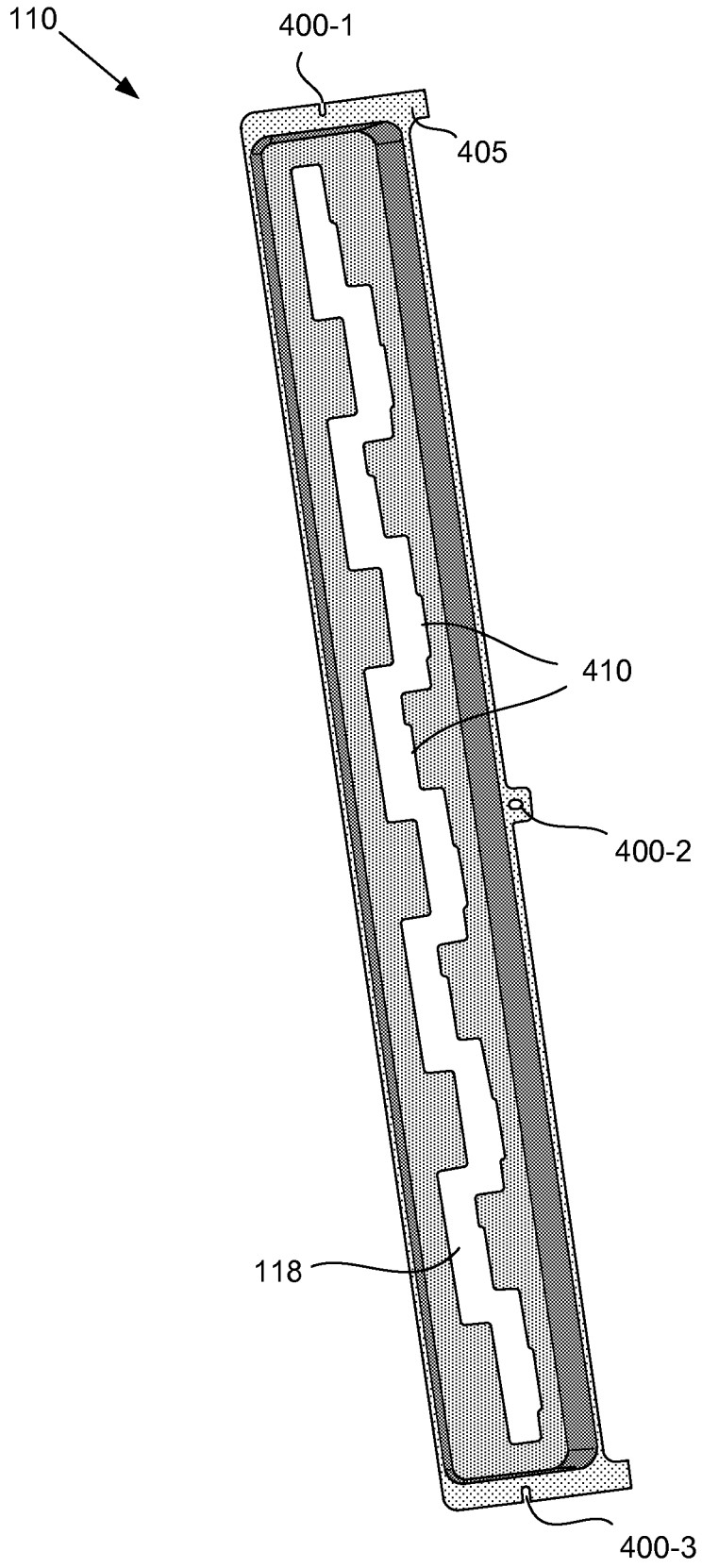
FIG. 4A is a diagram of an illustrative shroud, according to one embodiment of principles described herein.

FIG. 4A is a diagram of an illustrative shroud (110) which is attached to the backbone (115, FIG. 1) of the printhead (100, FIG. 1). The shroud (110) can include a number of features, including a central cutout (118), manufacturing alignment features (400), encapsulation cutouts (410) and perimeter tabs (405). In this example, the shroud (110) has one continuous cutout (118) which exposes the upper surfaces of all the die (105, FIG. 2) when the shroud (110) is in place. The manufacturing alignment features may include slots (400-1, 400-3), holes (400-2), pins or other features which would allow for alignment during manufacturing processes. The perimeter tab (405) may serve similar purposes during manufacturing or assembly of the printhead (100, FIG. 1).

Figure 4B:
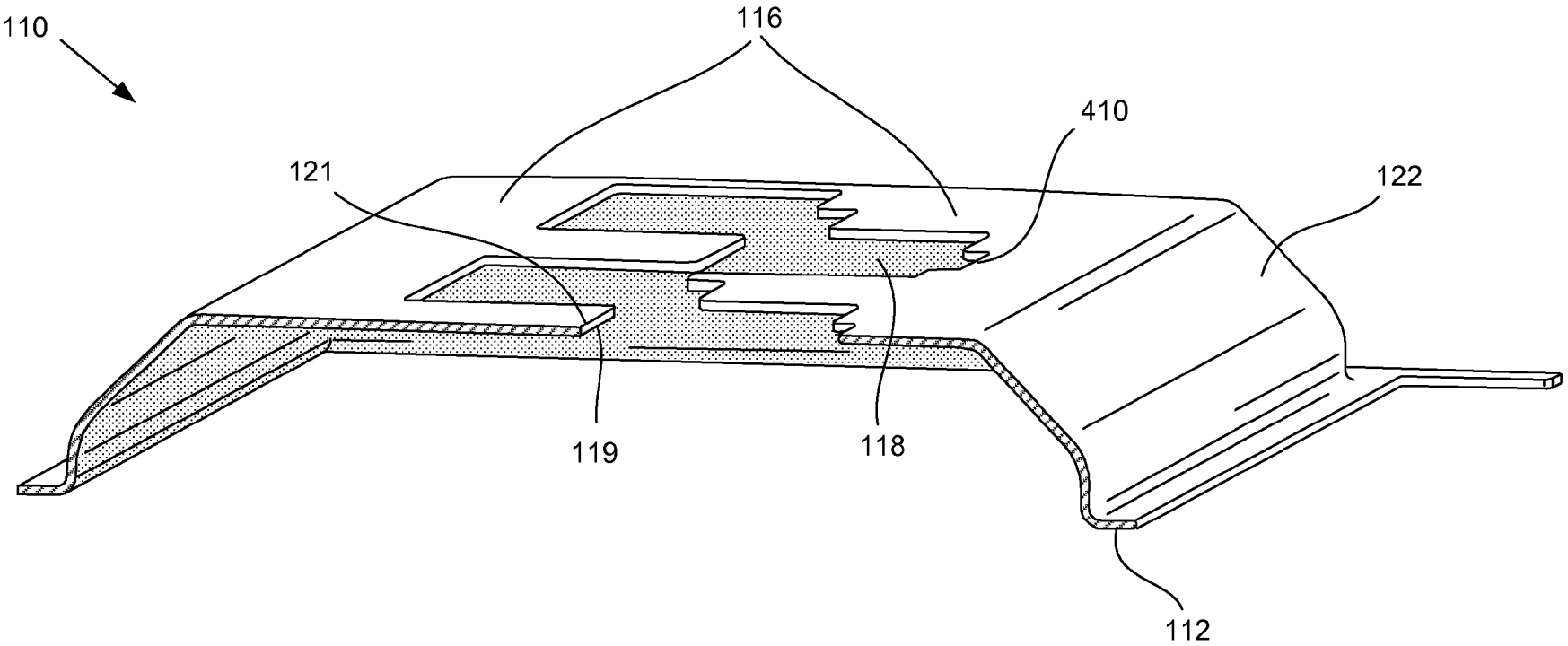
FIG. 4B is a cut away perspective view of an illustrative shroud, according to one embodiment of principles described herein.

FIG. 4B is a cut away perspective view of an illustrative shroud (110). As discussed above, the shroud (110) includes a cutout (118) in the capping surface (116) and a perimeter flange (112). The cutout (118) includes portions which are configured to expose the upper surfaces of the die (105 ,FIG. 2) and encapsulation cutouts (410) which accommodate the die connections (124 FIG. 2). In this embodiment, the cutout (118) has a rolled edge (121) and a burred edge (119). The rolled edge (121) prevents the wiper, cap or other material from catching on the shroud (110) by eliminating sharp edges and corners. The burred edge (119) is less rounded but has been machined to remove sharp protrusions. Ramps (122) are angled portions of the side wall. Although the ramps (122) can be at any angle, in this example, the ramps (122) are at approximately a 45 degree angle. The desired angle of the ramps (122) could be determined by a number of factors including the desired stiffness of the shroud (110), wiping design, and other objectives.

A variety of other features of the shroud (110) could also be varied from the embodiment shown in FIG. 4B. For example, the interior portions of the shroud (110) could be angled downward in order to improve the conformation of the shroud (110) to the die (105, FIG. 2). In another example, shroud (110) could also be used to form a sealing surface around an inline or abutting array of inkjet die. Similar to the staggered die (105, FIG. 2), there is insufficient space between the die (105, FIG. 2) for a capping surface. The shroud (110) could be placed over the inline die (105, FIG. 2) array to provide protection and a capping surface.

The sheet metal shroud (110) has a number of advantages over a plastic injection molded shroud. For example, extending the shroud length to an A3 sized media or larger is easier and less expensive when using a sheet metal shroud. Additionally, the stiffness of the sheet metal shroud can be tuned by simply using thicker metal. In contrast, changing the stiffness of an injection molded part may require the redesign of a mold, creation of additional gussets or ribs. The addition of gussets or ribs to the design can have a detrimental influence on the surface flatness of the plastic injection molded design. The sheet metal shroud does not require any secondary operations to produce a flat surface. Instead of relying on its own intrinsic structure to produce a very flat surface, the sheet metal shroud is supported by the die carriers which have been precision molded and precisely aligned. Further, the sheet metal design is thinner than a plastic injection molded shroud and allows the shroud to be place closer to the die and the flex cable.

Figure 5:
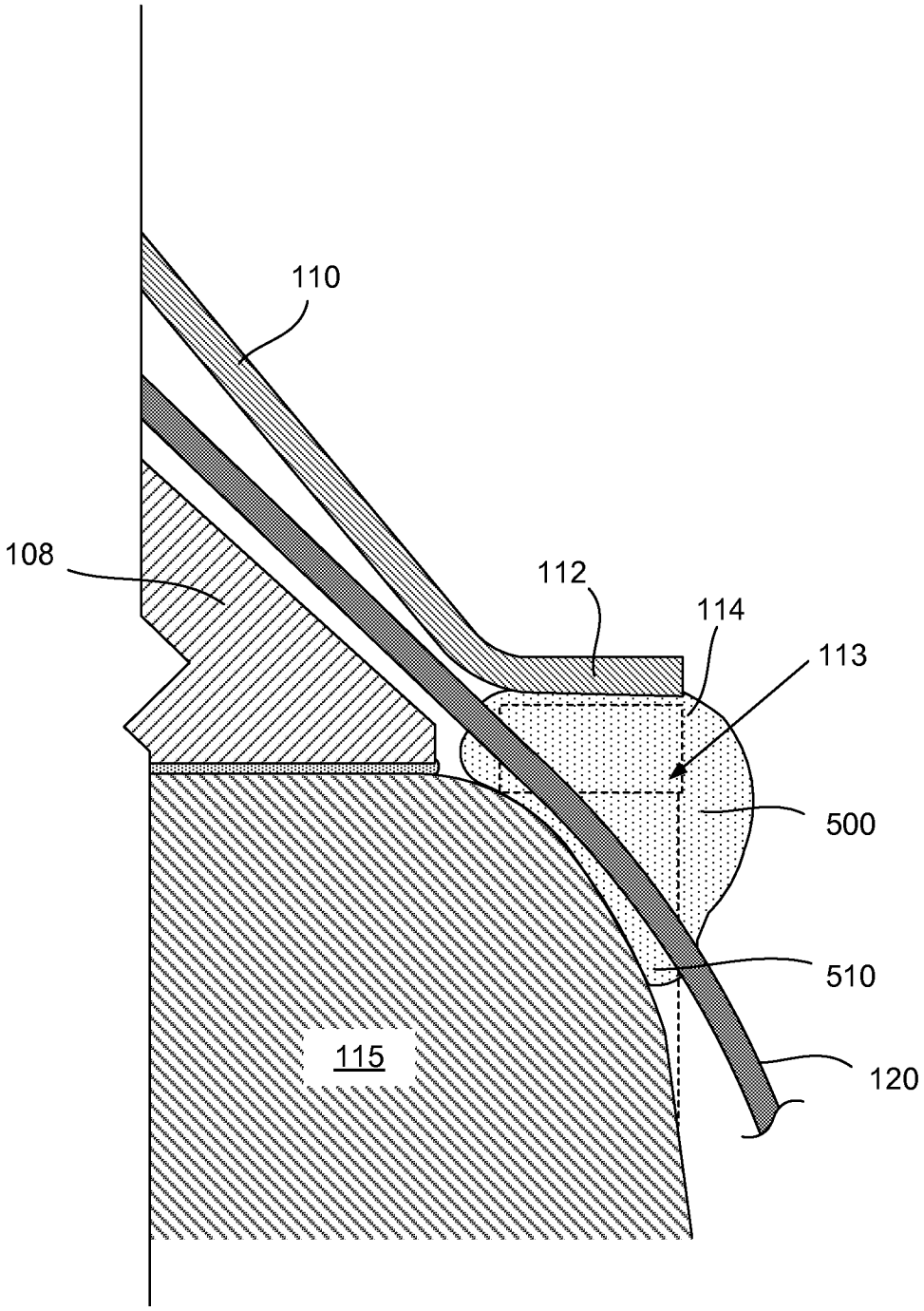
FIG. 5 is a cross sectional diagram of one illustrative method for sealing the shroud onto the backbone, according to one embodiment of principles describe herein.

FIG. 5 is a cross sectional diagram showing one illustrative method for sealing the flex cable (120) into indentations (113) in the rail (114). After the die assembly (140, FIG. 3B) has been secured in place on the backbone (115), a first portion of adhesive sealant (510) is deposited into the rail indentation (113). The flex cable (120) is placed into the rail indentation (113) and in contact with the first portion of the adhesive sealant (510). As discussed below, the second end of the flex cable (120) can then be connected to the printed circuit board (125, FIG. 2). A second portion of adhesive sealant (500) is deposited over the portion of the flex cable (120) in the rail indentation (113) and on the rail (114). The shroud (110) is then placed so that the underside of a capping surface (116, FIG. 4B) contacts support features (135, 137, FIG. 3B) on the die carriers (108) and the perimeter flange (112) of the shroud (110) is sealed over the rail (114) and rail indentations (113). This creates an adhesive seal between the backbone (115) and flange (112), with the flex cable (120) passing through the adhesive seal. The adhesive sealant (500, 510) is then cured while a force is applied which biases the shroud (110) against the support features (135, 137 FIG. 3B).

FIGS. 6A and 6B show illustrative flex cable connections. As discussed above, electrical signals and power are supplied to the die (105) from the printed circuit board (125) through flex cables (120). These electrical connections represent a significant portion of the printhead (100, FIG. 1) assembly cost. To minimize the distance between the die (105), it is desirable for each of the die to be directly connected to the printed circuit board rather than use a single flex cable which is connected to and routed between the die (105). In this embodiment, a single printed circuit board (125) delivers signals and power to each die (105) through individual flex cable (120) connections.

FIG. 6A shows one illustrative die connection (625) between a flex cable (120) and a die (105). In this example, conductors (600) extend out of the flex cable (120). These conductors (600) are typically copper with gold plating. The conductors (600) are TAB bonded to the specific die contacts (106) on the die (105). After the conductors (600) are connected to contacts (106), a bend is formed in the conductors (600). By bending the conductors (600), the flex cable (120) can exit the connection at the desired direction. This direction is typically down and away from the die connection (625) to minimize the length of the flex cable (120) and the interference of the flex cable (120) with the shroud (110, FIG. 2). In one embodiment, the electrical conductors (600) are bent such that the flex cable (120) exits the die connection (625) at an acute angle (606) with respect to a side of the die (105). If the conductors (600) were not bent as shown in FIG. 6A, the flex cable (120) itself could be bent to eventually direct the flex cable (120) in the desired direction. However, the radius of curvature of the flex cable (120) bend may be at least one or two orders of magnitude greater than the conductor bend (605). This could result in interference between the flex cable (120) and the shroud (110, FIG. 2) and in a longer overall length of the flex cable (120). Further, the flex cable (120) bend may be elastic. Consequently, there would be undesired residual stress in the flex cable (120).

The die attachment is further discussed in U.S. Pat. No. 6,626,518, entitled "Bending a TAB Flex Circuit Via Cantilevered Leads," to Silam J. Choy, and U.S. Pat. No. 6,722,756, entitled "Capping Shroud for Fluid Ejection Device" to Silam J. Choy et al., which are incorporated herein by reference in their entirety.

FIG. 6B shows the printer circuit board connection (630) at the opposite end of the flex cable (120) where the flex cable (120) connects to the circuit board (125). In this example, the flex cable (120) is pressed onto a film adhesive (610). Wire bonding can then be used to join the flex cable contacts (615) to the circuit board pads (620). The wire bonding process is configured to optically match the appropriate flex cable contacts (615) and circuit board pads (620) and make one or more wire bond connections (635) between the appropriate pads (615, 620). Fiduciary features on the pads (615, 620) assist in making the optical identification of the pads (615, 620). Consequently, it is not necessary to precisely locate the flex cable (120) on the film adhesive (610) because the wire bonding process can compensate for small positioning errors.

The embodiments described above are only illustrative examples of a wide-array inkjet printhead. A variety of other embodiments could also apply to the principles disclosed herein. For example, adhesive could be used to attach the shroud to the die carrier modules or to attach the support features to the shroud. Sealing the gap between the shroud and the die, die connection, and flex cable could reduce the amount of ink which enters the interior cavity of the shroud.

Figure 7:
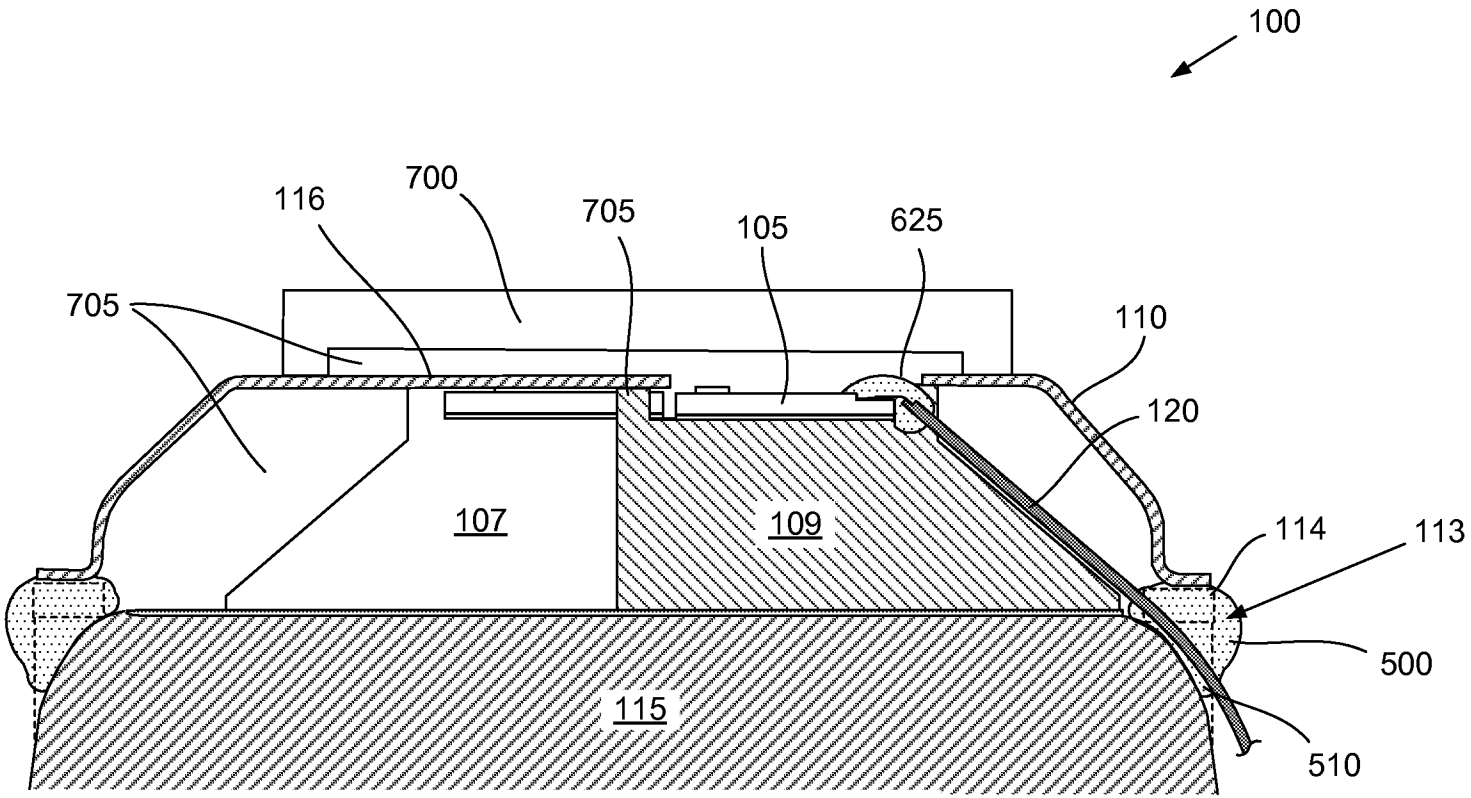
FIG. 7 is a cross sectional diagram of a wide-array inkjet printhead with a shroud and cap, according to one embodiment of principles describe herein.

FIG. 7 is a cross sectional diagram of a portion of an illustrative printhead assembly (100). As discussed above, left facing die carriers (107) and right facing die carriers (109) are attached in a back-to-back configuration on the backbone (115). The die carriers (107, 109) include support features (705). The die (105) are attached to the die carriers (107, 109). The flex cables (120) make electrical connections between the die (105) and the printer circuit board (125, FIG. 6B). The flex cables (120) pass through adhesive sealant (500, 510) in the rail indentations (113). The shroud (110) is sealed over the rail (114) and rail indentations (113). The cap (700) is placed in contact with the capping surface (116) when the printhead assembly (100) is not in use and creates an enclosed volume (705). A small portion of the carrier fluid in the ink evaporates into the enclosed volume (705) and raises the humidity to prevent further evaporation. This prevents undesirable ink solid deposits and increases the operating lifetime of the printhead assembly (100). The profile specification of the capping surface (116) may be measured with respect to a number of reference planes, including the upper surfaces of the die (105) or the upper surfaces of the support features (705).

Figure 8:
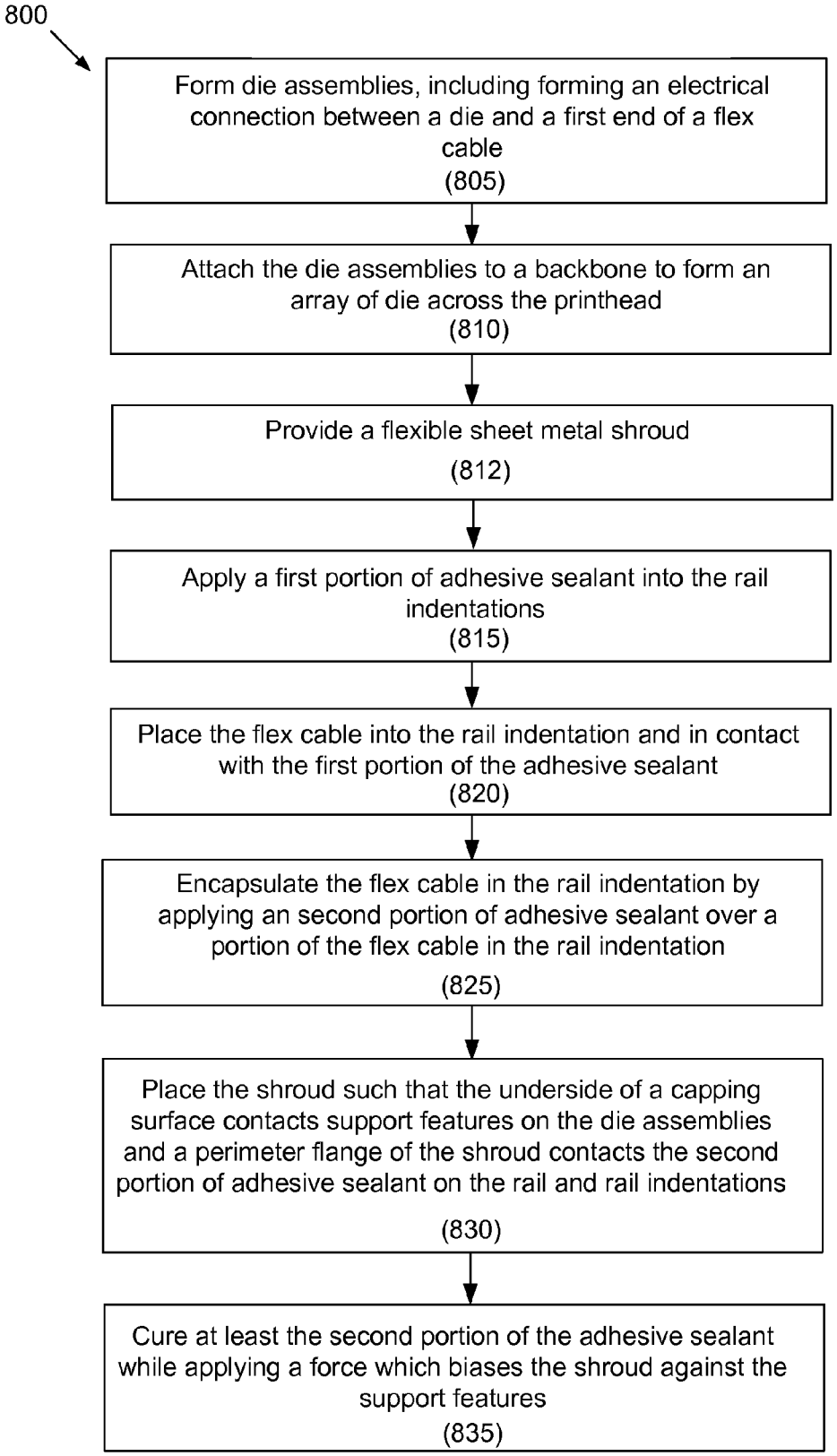
FIG. 8 is a flowchart of an illustrative method for sealing a shroud onto a wide-array inkjet printhead, according to one embodiment of principles described herein.

FIG. 8 is a flowchart of an illustrative method for assembling a wide-array inkjet printhead. In general, the method includes biasing a capping surface of a flexible sheet metal shroud against support features of a die carrier such that the surface profile of the capping surface has a surface profile with reduced deviation and meets a target profile specification.

Specifically, die assemblies are formed including making an electrical connection between the die and the first end of the flex cables (805). The die assemblies are attached to the backbone to form an array of die across the printhead (810). A first portion of adhesive sealant is deposited into the rail indentations (815). A flexible sheet metal shroud is provided (812). The flexible sheet metal shroud has a capping surface with a surface profile that deviates from a reference plane by more than a target deviation. A flex cable is placed into the rail indentations and in contact with the first portion of the adhesive sealant (820). The flex cable is encapsulated in the rail indentation by applying a second portion of adhesive sealant over the portion of the flex cable in the rail indentation (825). This second portion of adhesive sealant is also placed on top of the rail. The shroud is placed such that the underside of the capping surface contacts support features on the die assemblies and a perimeter flange of the shroud contacts the second portion of adhesive sealant on the rail and rail indentations (830). At least the second portion of the adhesive is cured while applying a force which biases the shroud against the support features on the die carriers (835). The surface profile of the capping surface then deviates from the reference plane by no more than a target deviation. The first portion of adhesive sealant could be cured previous to the deposition of the second portion of adhesive sealant or it could be cured together with the second portion of adhesive sealant.

In conclusion, the specification and figures describe a wide-array inkjet printhead which incorporates die carriers covered by a shroud and electrically connected to a circuit board by flex cables. The shroud is made from sheet metal and is flexible prior to incorporation onto the printhead.

The shroud is manufactured to a profile specification which is less stringent than a target profile specification. When the shroud is biased against the support features, the capping surface has a surface profile with reduced deviation and meets the target profile specification for effective capping of the die. By manufacturing a flexible shroud to relaxed surface profile specifications, the shroud can be inexpensive and thin while still meeting the target profile specification when assembled.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A wide-array inkjet printhead assembly comprising:

a backbone;

an array of die in which the die are mounted on die carriers, the die carriers being attached to the backbone and comprising support features;

a shroud comprising a capping surface with a surface profile that deviates from a reference plane by more than a target deviation when not coupled to the inkjet printhead assembly;

in which the support features interface with and support an undersurface of the shroud such that the capping surface of the shroud, when biased against the support features, deviates from the reference plane by no more than the target deviation.

2. The printhead assembly of claim 1, in which the backbone comprises a rail which encircles the array of die, and the shroud further comprises a flange formed around a perimeter of the shroud, in which the flange is bonded to the rail such that when a cap is brought into contact with the capping surface, an enclosed volume is formed which contains the die.

3. The printhead assembly of claim 2, further comprising:

a printed circuit board; and flex cables which individually connect each of the die to the printed circuit board, each of the flex cables having a die connection and a circuit board connection.

4. The printhead assembly of claim 3, in which the rail further comprises indentations, the flex cables passing through the indentations, the indentations being filled with adhesive sealant to form a seal around the flex cables and with the flange.

5. The printhead assembly of claim 3, in which the shroud further comprises a cutout in the shroud, upper surfaces of the die being exposed through the cutout.

6. The printhead assembly of claim 5, in which the die carriers are staggered back-to-back across a portion of the backbone, the cutout in the shroud exposing the upper surfaces of all of the die.

7. The printhead assembly of claim 5, in which the cutout comprises 30 an encapsulation cutout which accommodate the die connection.

8. The printhead assembly of claim 3, in which the die connection comprises: electrical conductors extending out from a first end of the flex cable, the electrical conductors being bonded to die contacts on the die.

9. The printhead assembly of claim 8, in which the electrical conductors are bent such that the flex cable exits the die connection at an acute angle with respect to a side of the die, the die connection further comprising adhesive sealant supporting and encapsulating the die contacts, the electrical conductors, and the first end of the flex cable.

10. The printhead assembly of claim 3, in which the printed circuit board connection comprises:

a printed circuit board comprising circuit board pads;

an adhesive film adhered to the printed circuit board;

a second end of the flex cable having flex cable contacts and being pressed onto the adhesive film; and wire bonds which are formed between the flex cable contacts and the circuit board pads such that the wire bonds compensate for misalignment between the flex cable contacts and the circuit board pads.

11. The printhead assembly of claim 2, in which the shroud is attached to the backbone such that the capping surface of the shroud is biased against the support features by an adhesive bond between the flange and the rail.

12. The printhead assembly of claim 1, in which the shroud is formed from sheet metal having a thickness which is less than 0.5 millimeters.

13. The printhead assembly of claim 1, in which the shroud is formed from stainless steel sheet metal having a thickness of approximately 0.25 millimeters.

14. A shroud for a wide-array printhead assembly comprising:

a flange around the perimeter of the shroud to seal to a rail on a backbone;

a cutout to expose a staggered back-to-back array of inkjet die, the inkjet die being disposed on die carriers having support features; and a capping surface to interface with a cap, the underside of the capping surface being biased against the support features of the die carriers to achieve a profile specification of less then 0.2%;

in which the shroud is formed from stainless steel with a thickness of less than 0.5 millimeters and is manufactured to a profile specification which is greater than 0.2%.

15. A method for assembling a wide-array printhead assembly comprises:

providing a flexible sheet metal shroud having capping surface with a surface profile that deviates from a reference plane by more than a target deviation; and biasing the capping surface of the flexible sheet metal shroud against support features such that the surface profile of the capping surface deviates from the reference plane by no more than the target deviation.

* * * * *

UNITED STATES PATENT AND TRADEMARK OFFICE

CERTIFICATE OF CORRECTION

PATENT NO. : 8,702,200 B2
APPLICATION NO. : 13/703171
DATED : April 22, 2014
INVENTOR(S) : Silam J. Choy It is certified that error appears in the above-identified patent and that said Letters Patent is hereby corrected as shown below:

IN THE CLAIMS:

In column 10, line 66, in Claim 7, after “comprises” delete “30”.

In column 12, line 14, in Claim 14, delete “then” and insert -- than --, therefor.

Signed and Sealed this
Fourteenth Day of April, 2015

Michelle K. Lee

Michelle K. Lee
*Director of the United States Patent and Trademark Office*